United States Patent [19]

Coulson

[11] Patent Number: 4,782,600

[45] Date of Patent: Nov. 8, 1988

[54] JET TUBE ASSEMBLY FOR A JET TUBE SHEET DRYER

[76] Inventor: Fred Coulson, Post Office Box 989, Eagle Point, Oreg. 97524

[21] Appl. No.: 19,572

[22] Filed: Feb. 27, 1987

[51] Int. Cl.[4] ..... F26B 3/04; F26B 13/04

[52] U.S. Cl. ..... 34/23; 34/155; 34/159

[58] Field of Search ..... 34/155, 158, 159, 160, 34/161, 162, 163

[56] References Cited

U.S. PATENT DOCUMENTS

| | | | |
|---|---|---|---|
| 3,739,490 | 6/1973 | Comstock | 34/155 |
| 4,021,931 | 5/1977 | Russ et al. | 34/159 |
| 4,428,128 | 1/1984 | Coulson et al. | 34/155 |
| 4,505,053 | 3/1985 | Andersson et al. | 34/155 |

*Primary Examiner*—Larry I. Schwartz

*Attorney, Agent, or Firm*—Dellett, Smith-Hill & Bedell

[57] ABSTRACT

A jet tube assembly for a jet tube sheet dryer comprises a jet tube which is generally rectangular in cross section and tapers from a large, air-delivery end to a small end. A rod is attached to the tube at the small end thereof in a manner such as not to block the small end of the tube and to project beyond the small end of the tube substantially in alignment with the longitudinal axis of the tube. A closure member is formed with an aperture so that it can fit over the rod and move relative thereto between a first position, in which the small end of the tube is substantially blocked, and a second position in which a substantial portion of the cross sectional area of the tube at its small end is unobstructed by the closure member.

12 Claims, 3 Drawing Sheets

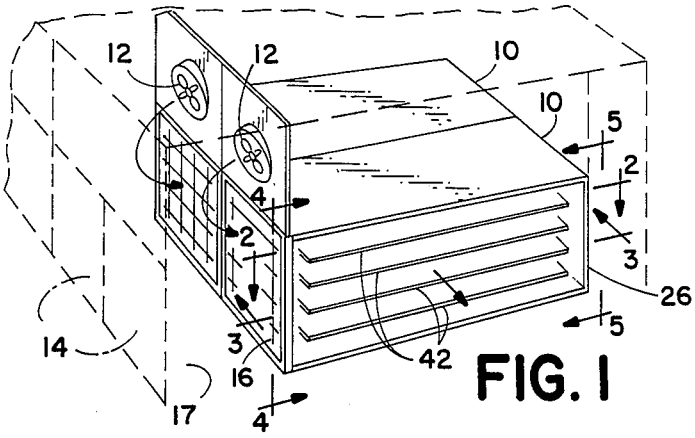
FIG. 1
FIG. 2
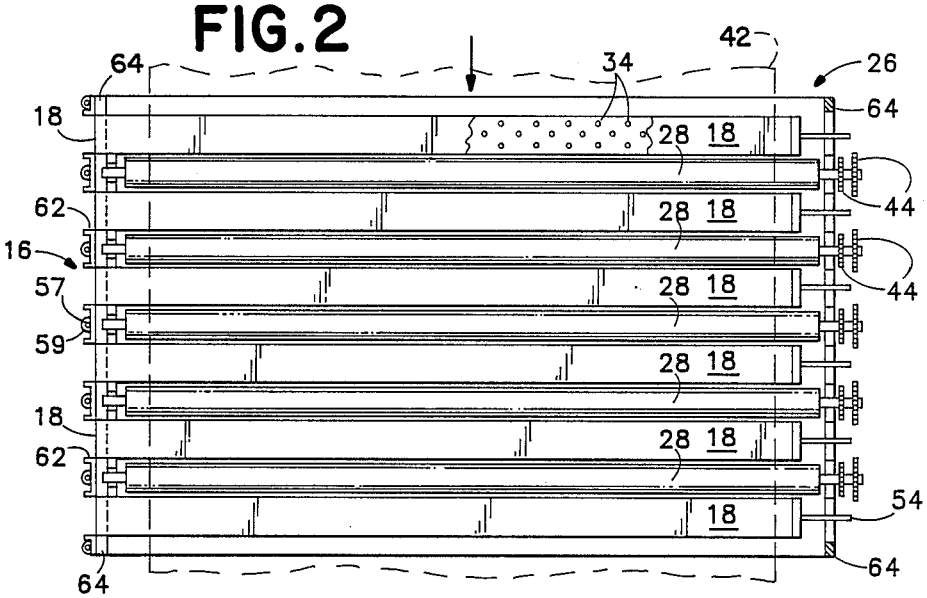
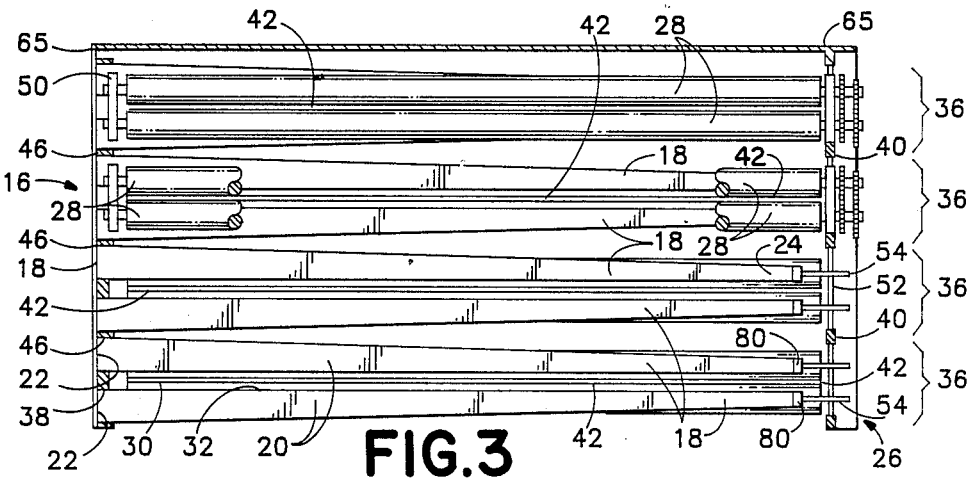
FIG. 3

JET TUBE ASSEMBLY FOR A JET TUBE SHEET DRYER

This invention relates to a jet tube assembly for a jet tube sheet dryer.

BACKGROUND OF THE INVENTION

Jet tube sheet dryers, commonly known as jet tube dryers, are used to dry sheets such as wood veneer.

A jet tube sheet dryer of the type manufactured by The Coe Manufacturing Co. of Painesville, Ohio, (hereinafter referred to as a "Coe jet tube dryer") typically comprises twelve to twenty-five dryer sections, each of which has an air-delivery end and a chain drive end. Each dryer section contains four dryer decks, and each dryer deck has six pairs of elongate, vertically-opposed, horizontal jet tubes. Between each two adjacent pairs of jet tubes is a pair of vertically-opposed, horizontal veneer rollers. The veneer rollers define the path of movement of sheets of veneer through the dryer section. The jet tubes and the veneer rollers extend longitudinally between the air-delivery end of the dryer section and the chain drive end thereof. Each jet tube is of generally rectangular cross-section and has vertical walls which taper longitudinally from a large open end to a small closed end. Each tube has a flanged collar on the open end and a mounting bracket on the closed end. Lateral frame members are provided at the air-delivery end at the levels of the different dryer decks, and at the chain drive end there are lateral frame members intermediate the dryer deck levels. The green (wet) veneer is supported and moved through the dryer by the roller pairs driven by a chain and sprocket arrangement. The jet tubes are installed in the dryer section framework with their open ends at the air-delivery end of the dryer section and their closed ends at the chain drive end. A longitudinally-extending bottom side of the upper tube of a pair faces a parallel, longitudinally-extending top side of the lower tube of the pair. These parallel, facing, longitudinally-extending sides each have a plurality of holes formed therein. Fans, located above the dryer section, force heated air down toward a dryer door, located a few feet from the air-delivery end of the dryer section. The door deflects the heated air into the open end of the jet tubes. Thus, pressurized heated air is directed at the green veneer moving through the dryer from the holes in the jet tubes. The partially-enclosed area between the dryer doors and the air-delivery end of the dryer functions as a plenum where pressure is built up because of the greater capacity of the fans to direct heated air to the plenum than of the jet tubes to bleed off heated air from the plenum. The holes serve to maintain a generally uniform pressure throughout the length of the tube in an airstream flowing therethrough.

In most jet tube sheet dryers, each jet tube has a flanged collar on its open end. The tubes are installed into the dryer from the air-delivery end thereof and the flanged collars overlap dryer frame members at the air-delivery end. Retainer plates are placed over the flanges and are attached to the frame members of the dryer. The retainer plates prevent withdrawal of the jet tubes from the dryer. In addition, the flanges and the retainer plates together serve to substantially block passage of forced air through the dryer otherwise than by way of the interiors of the jet tubes.

The Coe Manufacturing Company manufactures two main models of jet tube dryer, namely the M-62 and the M-72. In each case, the tube is 15'4½" long and about 6" wide. However, the open end of the jet tube for the M-62 dryer is about 6 inches high, whereas the open end of the tube for the M-72 dryer is about 7.5 inches high. Therefore, jet tubes for the two dryers are not interchangeable. Moreover, seven different flange designs are employed in the M-62 dryer and three different flange designs are employed in the M-72 dryer. Accordingly, if a mill has both M-62 dryers and M-72 dryers, it is necessary to carry several different jet tubes in inventory if down time is to be minimized.

One of the major malfunctions that occurs in a jet tube sheet dryer is known as a plug-up. In a plug-up, the flow of veneer is blocked. A plug-up may be caused by distortion of a jet tube, e.g., sagging of the upper jet tube, so that it obstructs the veneer path, or by failure of the bearings of the veneer rollers, resulting in the track of the veneer being altered. When a plug-up occurs, a fire may ensue, causing greatly elevated temperatures in the dryer. If the fire is put out using water, the temperature change may generate substantial residual stresses in the jet tubes, causing warping. Obviously, the dryer is out of service until the fire is put out and any necessary repairs have been made.

The jet tubes manufactured by The Coe Manufacturing Company for use as original equipment in the M-62 and M-72 jet tube sheet dryers comprise a wide channel section component and two narrower channel section components. The two narrower components are welded together and are fitted in the open side of the wide component. This type of tube is complex and expensive to manufacture.

A jet tube may be manufactured to fit the Coe M-62 or M-72 jet tube sheet dryer from a generally trapezoidal sheet of steel that is folded along four longitudinal fold lines so as to bring the two edges of the sheet, that extend longitudinally of the tube, together, and the two edges are lock seamed and tack welded together. Because this type of tube is made from a single sheet of steel, residual stresses are set up on the material during manufacture. Therefore, these tubes cannot readily be straightened after warping even by breaking the weld, because the residual stresses cannot be fully released.

It frequently occurs that during operation of a jet tube sheet dryer, debris accumulates inside the jet tubes, reducing the efficiency of the dryer and increasing the danger of fires. In order to remove debris from a jet tube of a conventional M-62 or M-72 jet dryer, it is normal to introduce a high pressure jet of water into the tube by way of its large end, and thereby force the debris from the tube by way of the holes in the sides facing the veneer path. However, the water jet tends to compact the debris at the small end of the tube. In some dryers there is an opening at the small end of the jet tube to allow the water jet to eject the debris from the tube by way of the opening. This expedient has not proved successful, because in order to avoid reducing the airflow towards the veneer it is necessary to provide the opening with a removable plug, but the plugs are frequently mislaid and therefore cannot be replaced after cleaning is completed. Moreover, because the opening is quite small, there are spaces that are not disturbed by the flow of water through the tube and debris tends to accumulate in those spaces.

Attempts have been made to clean this type of tube by backwashing: inserting a pipe through the hole at the small end of the tube and delivering water into the tube by way of the pipe. This method also results in packing of debris in the small end of the tube. Consequently, it is frequently necessary to remove the tubes from the dryer in order to clean them. Each tube in turn is removed from the dryer, stood vertically with its large end down, and banged so as to displace debris from the interior of the tube. Since each tube is over 15 feet long and weights about 50 pounds, and a typical jet tube dryer includes more than 500 tubes, it will be seen that it is a time-consuming task to maintain the tubes free of debris.

All Moore International jet tube sheet dryers that were in commercial use prior to 1968 employed vertical frame rails to support the jet tubes. At each end, the jet tube was positioned between two adjacent vertical frame rails and was supported at its sides by those rails. However, due to the weight of the dryer the vertical frame rails tended to warp and buckle. If two adjacent rails buckled together, it became impossible to insert a jet tube between the rails until the rails had been straightened. In 1968, Moore International abandoned use of vertical frame rails, in favor of horizontal frame rails. A bolt which is secured to one of the horizontal frame rails engages a sleeve which projects from the small end of the tube in order to support the tube at the chain drive end of the dryer. The jet tubes of all jet tube sheet dryers manufactured after 1968 are supported at their small ends by engagement of a member projecting from the small end of the tube with a member that is stationary relative to the support frame.

During the period from 1962 to 1968, Moore International manufactured a jet tube sheet dryer in which the jet tube was provided with a removable end cap at its small end. The end caps were held in position by a pin which extended vertically through the small ends of two adjacent tubes and the caps received by those tubes. It was found to be difficult to insert the pins, since each pin had to pass through eight holes and the warping of the tubes caused misalignment of the holes and bending of the pins. Therefore the end caps frequently were not replaced, and consequently the dryer ceased to function correctly. It was not possible to use removable end caps on the jet tubes in a dryer with horizontal frame rails, because of the member projecting from the small end of the tube. Therefore, use of jet tubes with removable end caps was abandoned in 1968.

The flanges on the jet tubes that are conventionally provided for the Coe M-62 dryer are so wide that they partially cover the bearings at the air-delivery end of the dryer. Consequently, it is difficult to inspect the bearings except when the tubes are removed, and so the bearings are not inspected sufficiently often. Because the bearings cannot be inspected readily, they do not receive proper maintenance and are subject to relatively frequent failure.

It has been proposed in U. S. Pat. No. 4,428,128 issued Jan. 31, 1984 (Coulson et al) that jet tubes without flanges be employed. However, this solution is subject to the disadvantage that the absence of flanges allows air to leave the plenum without entering a jet tube, by passing between the tubes.

SUMMARY OF THE INVENTION

A preferred jet tube assembly embodying a first aspect of the invention comprises a elongate jet tube that is generally rectangular in cross section and tapers from a large, air-delivery end to a small end. A rod is attached to the tube at the small end thereof in a manner such as not to block the small end of the tube and to project beyond the small end of the tube substantially in alignment with the longitudinal axis of the tube. A closure member is formed with an aperture so that it can fit over the rod and move relative thereto between first and second positions, and is sized so that in its first position the small end of the tube is substantially blocked and in the second position a substantial portion of the cross-sectional area of the tube at its small end is unobstructed by the closure member.

A preferred jet tube embodying a second aspect of the invention is made from two sheets of metal that can be fitted together in such a manner as to form a elongate tube that is generally rectangular in cross section and has four walls. Two opposite walls of the tube taper from a large air-delivery end of the tube to a small end and the other two opposite walls of the tube are of substantially uniform width over the length of the tube. The tube is formed in one of the uniform-width walls with an array of holes.

BRIEF DESCRIPTION OF THE DRAWINGS

For a better understanding of the invention, and to show how the same may be carried into effect, reference will now be made, by way of example, to the accompanying drawings in which:

FIG. 1 is a perspective view of two sections of a Coe M-62 jet tube sheet dryer, FIGS. 2, 3, 4 and 5 are partial sectional views taken on the lines 2—2, 3—3, 4—4, and 5—5 respectively of FIG. 1, FIG. 4(*a*) is a view similar to FIG. 4 of a part of a Coe M-72 jet tube sheet dryer.

Figure 4:
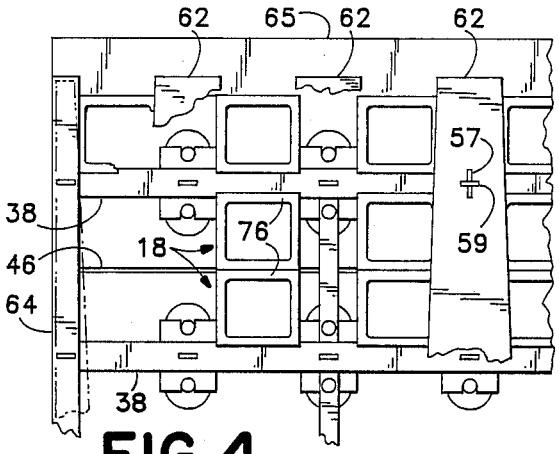
Figure 4A:
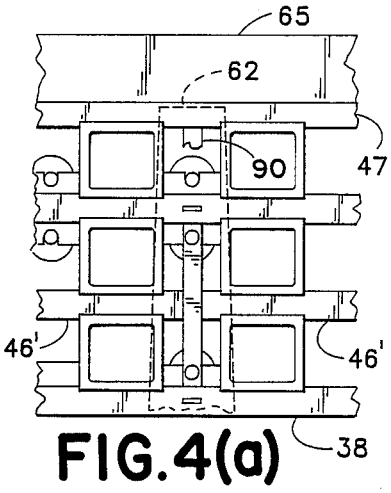

The present invention is concerned with jet tube assemblies that are specifically designed for use as replacement parts for Coe M-62 and M-72 jet tube sheet dryers. It is necessary to make minor modifications to the standard M-62 and M-72 dryers in order to receive the jet tube assemblies in accordance with the invention. Except as specifically pointed out below, the following description is applicable to both the M-62 and the M-72 dryer.

DETAILED DESCRIPTION

FIG. 1 shows two generally rectangular dryer sections 10 arranged adjacent to each other. Each dryer section has an air-delivery end 16 and a chain drive end 26. A complete dryer will customarily consist of twelve to twenty-five dryer sections arranged side by side in the manner shown in FIG. 1. Each dryer section has four dryer decks 36 (FIG. 3). Sheets 42 of green (wet) veneer or other material to be dried are moved through the dryer sections in a direction transverse to the longitudinal axis of each dryer section. Fans 12, usually located above the dryer sections, direct heated air from a hot air source (not shown) down toward the dryer doors 14 located several feet in front of the air-delivery end 16 of the dryer section 10. The space between the dryer doors 14 and the air-delivery end 16 acts a plenum 17 which distributes heated air under pressure to jet tube assemblies 18 (sometimes referred to hereinafter simply as jet tubes).

Figure 5:
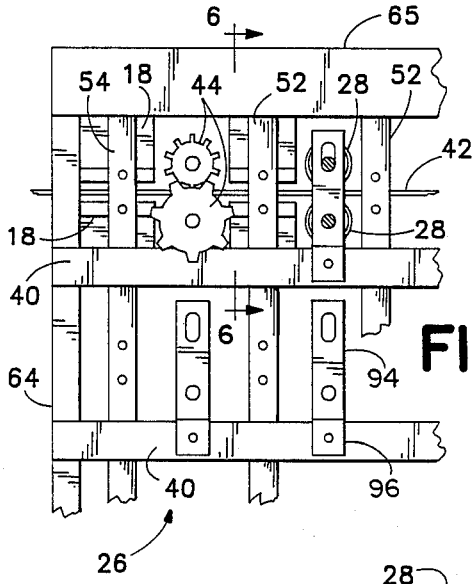

The jet tubes 18 (FIGS. 2–6) are elongate, tapered tubes of generally rectangular cross-section. The longitudinally-extending vertical sidewalls 20 of each tube 18 taper longitudinally from a large end 22 of the tube to a small end 24 as shown in FIG. 3. The tubes 18 are open at their large ends 22 and are provided with removable closure caps 80 at their small ends 24. The tubes extend generally parallel to each other with their large ends 22 at the air-delivery end 16 of the dryer section 10, as shown in FIG. 4, and their small ends 24 at the chain drive end 26 of the dryer section 10, which is shown in FIG. 5. Typically, each dryer section 10 contains forty-eight jet tubes 18 in an array of six columns by eight rows. Each vertical column of eight tube jets 18 is arranged into four pairs of vertically opposed jet tubes. There is a horizontal row of six tube pairs in each dryer deck 36. The jet tubes 18 are mounted in the dryer section 10 so that the longitudinally-extending bottom side 30 of the upper tube 18 of a pair is parallel to the facing longitudinally-extending top side 32 of the lower tube of a pair as shown in FIG. 3. These parallel facing sides 30 and 32 have numerous holes 34 formed therein as shown in FIG. 2.

Also arranged longitudinally in each dryer section 10 are pairs of veneer rollers 28 extending generally parallel to the jet tubes 18 from the air-delivery end 16 of the dryer section 10 to the chain drive end 26. Each dryer section 10 typically contains forty rollers 28 in an array of five columns by eight rows. Each vertical column of eight rollers 28 is arranged into four pairs of vertically opposed rollers. The rollers 28 alternate laterally with jet tubes 18 in a horizontal plane as shown in FIG. 2. There is a horizontal row of five roller pairs in each dryer deck 36. The nips of the five roller pairs of each dryer deck define a dryer plane in which the path of movement of a sheet of veneer passing through that dryer deck lies. Referring to FIG. 5, the rollers 28 are connected to sprockets 44 which are rotated by a drive chain (not shown) for rotating the rollers to convey the sheets 42 through the dryer section. Therefore, as sheets 42 of green veneer are carried through the dryer section 10 by the pairs of opposed conveyor rollers 28, the pairs of opposed jet tubes 18 direct jets of heated air toward the top and bottom surfaces of the sheets 42 through the holes 34 formed in the parallel facing sides 30 and 32 of the jet tubes 18 as partially shown in FIGS. 2 and 6.

The framework of the dryer section 10 includes four vertical beams 64 at the four corners of the section respectively and two horizontal beams 65 extending transversely of the dryer section at the air-delivery end and the chain drive end respectively. The air-delivery end 16 of the dryer has four lateral frame members 38 across the face thereof. The frame members 38 are positioned at substantially the level of the drying planes of the respective dryer decks. The chain drive end 26 has similar lateral frame members 40 which are intermediate the dryer decks 36. These lateral frame members 38 and 40 serve to strengthen the dryer section 10 and provide mounting support for the jet tubes 18 and the rollers 28. The frame members 38 also carry shackles 59 which extend through openings in retainer plates 62 and receive pins 57 for securing the retainer plates to the frame members 38.

At the chain drive end of the dryer, the bearings of each pair of rollers are supported in respective holes in a vertical bar 94. The bar 94 has a clevis 96 at its lower end, and fits over the horizontal frame member 40. Holes are formed in the clevis 96 and the frame member 40, and the bar 94 is secured to the frame member by a rod which extends through the holes and is retained in position, e.g., by conventional R-pins.

The frame members 38 and 40 are present in the standard M-62 and M-72 dryers. Preferably, the standard M-62 dryer is modified by adding a tube seat 46 between each pair of adjacent dryer decks at the air-delivery end of the dryer. The tube seat 46 is attached to the vertical frame members 48 and 64. In addition, the M-62 dryer is modified by providing vertical tube support bars 52 between the lateral frame members 40 at the chain drive end. Use of the tube seats 46 and the support bars 52 in the M-62 dryer is disclosed in U.S. Pat. No. 4,428,128. The standard M-72 dryer includes vertical tube support bars 52, and therefore it is not necessary to add such bars to the M-72 dryer. However, in the M-72 dryer the drying planes are about 3 inches farther apart than in the M-62 dryer. In order to enable the same jet tubes to be used in the M-72 dryer as in the M-62 dryer, horizontal bars 46' are welded between the vertical frame members at the air-delivery end of the M-72 dryer, in lieu of the tube seats 46 added to the M-62 dryer, as shown in FIG. 4(*a*). In addition, a longitudinal bar 47 is welded to the horizontal frame member 65. The horizontal bars 46' are about 3 inches wide and the bar 47 is about 1.5 inches wide. The bars 46' and 47 thus partially block the space provided in the M-72 dryer for receiving the tubes for which that dryer is designed and enable the narrower tubes, that also fit the M-62 dryer, to be used in the M-72 dryer without having to use wide flanges. By use of relatively narrow flanges on the open ends of the tubes 18, and appropriate retainer plates 62, the spaces between the flanges can be adequately blocked, so that pressurized air is not able to leave the plenum 17 except by way of the jet tubes 18, yet the bearings of the rollers at the air-delivery end of the dryer can be readily inspected. It will be noted that the plates 62 become wider towards the bottom so as to partially block the lower jet tubes and thereby compensate for the increased pressure that builds up at the bottom of the plenum 17.

The framework of the M-72 dryer includes vertical bars 90 at the air delivery end of the dryer. These bars 90 interfere with access to the bearings of the rollers, and therefore it is preferred that a hole be cut in each bar beneath the lower roller of each pair, to allow a tool to be inserted for pushing the lower roller upwards to enable the condition of the bearing of the lower roller to be determined.

Figure 6:
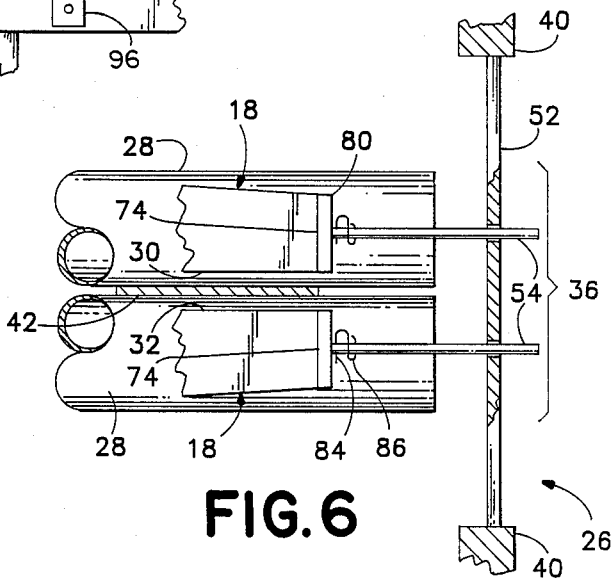
FIG. 6 is an enlarged, partial sectional view taken on the line 6—6 of FIG. 5, FIG. 6(*a*) is a partially broken away end view of a modified form of the jet tube assembly used in the FIG. 1 jet tube sheet dryer.
Figure 7:
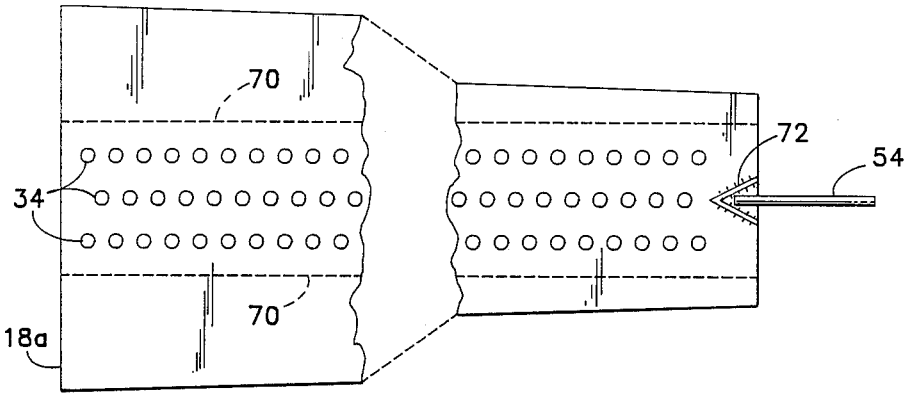
FIG. 7 is partial plan view of two components that are used to form a first part of a jet tube assembly that is used in the FIG. 1 jet tube sheet dryer.

Each of the dryer tubes is formed from two shells 18*a* and 18*b*. Each shell in made of sturdy steel plate, for example 14 gauge. The plates (FIG. 7) are ultimately bent along fold lines 70, but prior to such bending the plate 18*a* is formed with the holes 34. When the tube is fully assembled and is positioned in the dryer, the side of the tube in which the holes 34 are formed faces the path of movement of the veneer sheets, as shown in FIG. 6.

After bending of the plates along the lines 70, a V-shaped mounting bracket 72 is welded to the plate 18*a*.

Figure 8:
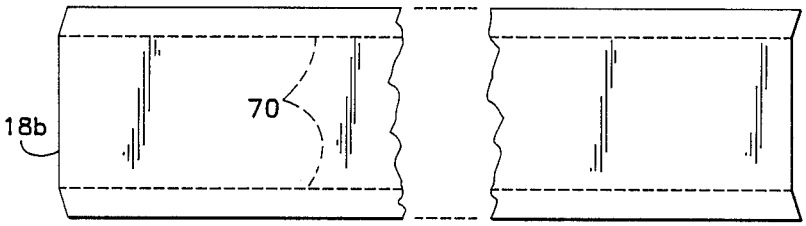
FIG. 8 is an end view of the first part of the jet tube assembly.
Figure 8:
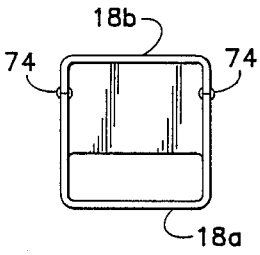
Figure 9:
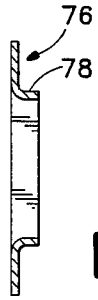
FIG. 9 is a sectional view of a second part of the jet tube assembly.
Figure 11:
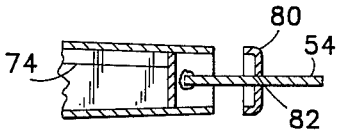
FIG. 11 is a sectional view of one end of the jet tube assembly.
Figure 6A:
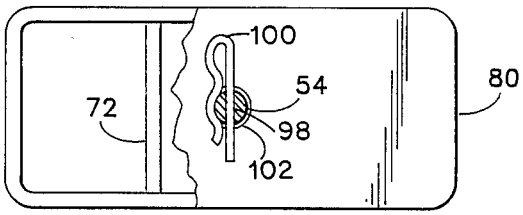

The apex of the V is directed towards the opposite end of the plate 18*a*. A post 54 is welded to the interior of the V-shaped bracket 72 so that it projects beyond the plate 18*a* generally parallel to the folds of the plate 18*a*. The two shells that are formed by bending the plates 18*a* and 18*b* are then placed with their long edges in confronting relationship and are tack welded together at their long edges along lines 74 (FIGS. 8 and 11). The large end of the resulting tube is then fitted over the boss 78 of a flange plate 76 (FIG. 9), and the flange plate is welded to the tube.

Figure 10:
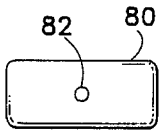
FIG. 10 is an end elevation of a third part of the jet tube assembly.

A cap 80 (FIGS. 6, 10 and 11) is shaped to fit against the small end of the tube 18, to substantially prevent the flow of air from the tube by way of its small end. The cap 80 is formed with a hole 82 and is mounted to the small end of the tube by inserting the post 54 through the hole 82, as shown in FIG. 11. The cap is held in position against the small end of the tube by a pin 84 (FIG. 6) which is inserted through a diametrical hole (not shown) in the post 54. When the pin is removed from the hole in the post 54, it is retained on the post by a loop 86 of wire, which is fitted over the post. An alternative technique for securing the cap 80 is shown in FIG. 6(*a*). The post 54 is formed with a hole 98 for receiving the straight limb of an R-pin 100. A coil spring 102 is fitted on the post 54 for taking up clearance between the cap 80 and the R-pin 100.

In order to install the tube in the dryer, the tube is inserted into the dryer framework, small end first, by way of the air-delivery end of the dryer section. The post 54 is inserted into a hole 55 in the vertical retainer bar 52 at the chain drive end 26 of the dryer section. Preferably, the hole 55 that receives the post 54 of the upper tube of a pair of opposed jet tubes is slotted so as to permit vertical movement of the small end of the upper tube. The flange at the large end of the tube engages the bar 38, and the tube is held in position by the vertical retainer plate 62. Therefore, the small end of the tube is free to move longitudinally and accommodate longitudinal expansion and contraction of the tube 18 and possible warping of the frame members of the dryer section.

When the tube has been installed, debris can be removed from the tube using a high pressure water jet. By removing the pin 84 from the hole in the post 54, the cap 80 is rendered free to move along the post away from the small end of the tube, leaving substantially the entire cross-sectional area of the small end of the tube unobstructed. Both the pin and the cap are captive on the post 84, and therefore will not be misplaced. The V-section of the bracket 72 ensures that there are no substantial areas at the small end of the tube in which debris forced along the tube by the high pressure water jet can become lodged.

Use of the removable end caps 80 facilitates use of an air flow for cleaning debris from the tubes. By simply removing the caps and running the dryer fans, a large amount of debris can be cleaned from the jet tubes without extensive clean-up being necessary, as is the case when water is used for cleaning the tubes.

In the event that the tube 18 is warped due to residual stresses resulting from sudden temperature changes, the residual stresses can be released by cutting the tack welds between the shells. The two shells can then be straightened and welded together again.

The tubes can be transported and stored in shell form, the shells being welded together and an appropriate flange attached when a replacement tube is needed. This both reduces the cost of transportation and storage and reduces the number of different articles that must be stored in order to provide a full range of replacement tubes for M-62 and M-72 jet tube dryers.

In the case of the M-72 dryer, additional horizontal bars are installed at the air-delivery end of the dryer section. These bars are about three inches wide on the center decks and 1.5 inches wide on the top and bottom decks, and serve to obstruct the area at the air-delivery end of the dryer section that is left open through use of the narrow jet tube.

It will be appreciated that the present invention is not restricted to the particular jet tube and dryer that have been described and illustrated, and that variations may be made therein without departing from the scope of the invention as defined in the appended claims and equivalents thereof. For example, mechanisms other than the pin 84 may be used to retain the end cap 80 in its closed position. In particular, a metal spring secured to the end cap in a position such as to bear against the post 54 may be used, since the frictional engagement of the spring with the post resists movement of the cap along the post. Alternatively, the end cap may be hinged to the tube at its small end along the upper side of the tube. This arrangement requires a slot in the cap in order to accommodate the post 54, but the mounting bracket 72 prevents substantial loss of heated air through the slot.

I claim:

1. A jet tube assembly for a jet tube sheet dryer, comprising an elongate jet tube that is generally rectangular in cross section and tapers from a large air-delivery end to a small end, a post rigidly attached to the tube at its small end in a manner such as not to block the small end of the tube and extending longitudinally of the tube beyond the small end of the tube, and a closure member formed with an aperture so that it can fit over the post and move relative thereto between first and second positions, the closure member being sized so that in its first position the small end of the tube is substantially blocked and in its second position a substantial portion of the cross-sectional area of the tube at its small end is unobstructed by the closure member.

2. A jet tube assembly according to claim 1, comprising a retainer mechanism for securing the closure member in its first position.

3. A jet tube assembly according to claim 2, wherein the post is formed with an aperture and the retainer mechanism comprises a pin which fits through the aperture.

4. A jet tube assembly according to claim 3, further comprising a compression spring fitted on the post for taking up clearance between the closure member and the pin.

5. A jet tube sheet dryer comprising a dryer frame having upper and lower horizontal frame members at one end of the dryer, and first and second pairs of opposed sheet conveyor rollers extending from said one end of the dryer to an opposite end thereof and supported at said one end of the dryer by said horizontal frame members respectively, the first pair of sheet conveyor rollers being directly above the second pair of sheet conveyor rollers and there being a space of a first predetermined height defined between the upper and lower frame members, and the dryer also comprising a horizontal bar member mounted at said one end of the dryer so as to extend parallel to the upper and lower frame members and equidistant therefrom, said horizontal bar member having a second predetermined height, and first and second jet tubes located in said space respectively above and below said horizontal bar member and extending alongside a roller of the first pair and a roller of the second pair respectively, each jet tube being generally rectangular in cross section and extending from a large end, at said one end of the dryer, to a small end, at said opposite end of the dryer, and having a third predetermined height at said small end, said third predetermined height being substantially less than half said first predetermined height and being substantially equal to half said first predetermined height minus said second predetermined height, and each jet tube having a flange at its large end, the width of the flange being less than half the second predetermined height.

6. A method of manufacturing a jet tube for a jet tube sheet dryer, comprising providing first and second elongate, substantially planar, generally trapezoidal sheets of metal, each sheet having two opposite side edges that extend longitudinally of the sheet and two opposite end edges that join the two side edges, defining two longitudinal fold lines for each sheet, the two fold lines being substantially parallel to each other and extending substantially perpendicular to the end edges of the sheet, folding each sheet along its two fold lines through substantially 90 degree so as to form a channel-section shell, and welding the two sheets together along said side edges so as to form a tube of generally rectangular cross-section.

7. A method according to claim 6, further comprising attaching a post to at least one of said sheets of metal so as to project substantially parallel to the longitudinal fold lines.

8. A method of modifying a jet tube sheet dryer that comprises a dryer frame having upper and lower horizontal frame members at one end of the dryer, and first and second pairs of opposed sheet conveyor rollers extending from said one end of the dryer to an opposite end thereof and supported at said one end of the dryer by said horizontal frame members respectively, the first pair of conveyor rollers being directly above the second pair of sheet conveyor rollers and there being a space of a first predetermined height defined between the upper and lower frame members for receiving first and second jet tubes so as to extend alongside respective rollers of the first and second pairs respectively, said method comprising mounting a horizontal bar member at said one end of the dryer so as to extend parallel to the upper and lower frame members and equidistant therefrom, said horizontal bar member having a second predetermined height, and inserting first and second jet tubes into said space respectively above and below said horizontal member, each jet tube being generally rectangular in cross section and extending from a large end, at said one end of the dryer, to a small end, at said opposite end of the dryer, and having a third predetermined height at said large end, said third predetermined height being substantially less than half to half said first predetermined height minus said second predetermined height, and each jet tube having a flange at its large end, the width of the flange being less than half the second predetermined height.

9. A method according to claim 8, wherein the dryer comprises at least one additional pair of opposed sheet conveyor rollers that is spaced horizontally from said first pair of conveyor rollers and the first jet tube is disposed between the first pair of conveyor rollers and the additional pair of conveyor rollers, and wherein the width of the flange is substantially less than the horizontal distance between the longitudinal axes of the rollers of the first pair of conveyor rollers and the longitudinal axes of the rollers of the additional pair of conveyor rollers, and the method further comprising mounting a vertical retainer plate to at least one of the horizontal frame members, said retainer plate having a width that is greater than said horizontal distance minus the width of the flange.

10. A jet tube assembly for a jet tube sheet dryer, comprising an elongate jet tube that is generally rectangular in cross section and tapers from a large, air-delivery end to a small end, a post rigidly attached to the tube at its small end in a manner such as not to block the small end of the tube and extending longitudinally of the tube beyond the small end of the tube, and a closure member attached to the tube at the small end thereof and movable relative thereto between first and second positions, the closure member being sized so that in its first position the small end of the tube is substantially blocked and in its second position a substantial portion of the cross-sectional area of the tube at its small end is unobstructed by the closure member.

11. A jet tube sheet dryer comprising a dryer frame having a horizontal frame member at one end of the dryer, a vertical frame member at an opposite end of the dryer, and a pair of opposed sheet conveyor rollers extending from said one end of the dryer to the opposite end thereof and supported at said one end of the dryer by said horizontal frame member, and the dryer also comprising first and second jet tubes located respectively above and below said horizontal frame member and extending alongside said rollers respectively, each jet tube being generally rectangular in cross section and extending from a large end, at said one end of the dryer, to a small end, at said opposite end of the dryer, and each jet tube having a flange at its large end, engaging said horizontal frame member and restricting movement of the tube in the direction from said one end of the dryer towards said opposite end thereof, and each jet tube having a post rigidly attached to the tube at its small end in a manner such as not to block the small end of the tube and extending longitudinally of the tube beyond the small end of the tube, and a closure member attached to the tube at the small end thereof and movable relative thereto between first and second positions, the closure member being sized so that in its first position the small end of the tube is substantially blocked and in its second position a substantial portion of the cross sectional area of the tube at its small end is unobstructed by the closure member, the posts of the first and second tubes being fitted in respective holes in the vertical frame member.

12. A jet tube sheet dryer according to claim 11, wherein the closure member of each jet tube is formed with an aperture so that it can fit over the post and move relative thereto between the first and second positions, and each jet tube further comprises a retainer mechanism for securing the closure member in its first position.

* * * * *